United States Patent [19]

Schultz

[11] Patent Number: 4,895,279

[45] Date of Patent: Jan. 23, 1990

[54] FLAT-TOP VALVE MEMBER FOR AN ATOMIZING PUMP DISPENSER

[75] Inventor: Robert S. Schultz, Old Greenwich, Conn.

[73] Assignee: Emson Research Inc., Bridgeport, Conn.

[21] Appl. No.: 223,650

[22] Filed: Jul. 25, 1988

[51] Int. Cl.[4] ..... B65D 88/54

[52] U.S. Cl. ..... 222/321; 222/385; 222/402.1; 239/333

[58] Field of Search ..... 222/321, 385, 383, 372, 222/373, 378, 376, 382, 263, 401, 402.1, 559; 239/333, 331; 417/549, 435, 545

[56] References Cited

U.S. PATENT DOCUMENTS

| | | | |
|---|---|---|---|
| 3,211,346 | 10/1965 | Meshberg | 222/263 |
| 3,399,836 | 9/1968 | Pechstein | 239/333 |
| 4,025,046 | 5/1977 | Boris | 239/333 |
| 4,051,983 | 10/1977 | Anderson | 222/321 |
| 4,089,442 | 5/1978 | Hafele et al. | 222/321 |
| 4,113,145 | 9/1978 | Meshberg | 222/1 |
| 4,230,242 | 10/1980 | Meshberg | 222/321 |
| 4,389,003 | 6/1983 | Meshberg | 222/231 |
| 4,735,347 | 4/1988 | Schultz et al. | 222/321 |

FOREIGN PATENT DOCUMENTS 2249716 5/1975 France .

*Primary Examiner*—Joseph J. Rolla
*Assistant Examiner*—Kenneth Noland
*Attorney, Agent, or Firm*—Kenyon & Kenyon

[57] ABSTRACT

An atomizing pump dispenser which includes a valve member having a flattened top so that the diameter of the sealing area in the outlet is increased substantially. A recess within the valve member is modified to provide conical ball sealing oprtions tapered at predetermined angles to provide a tight seal between the ball and the valve member. The innermost end of an inner hollow part of the valve member is a reduced diameter portion such that the initial movement of the valve member is easier. This in effect, tricks the user's finger by easing the initiation of movement of the actuator so as to give the feel of free movement. The inner part of the valve member is provided with a molded-in slotted protrusion for breaking the seal between the valve member and a flexible annular seal, thus alleviating the creation of the vacuum caused by the seal between the ball and the ball seat.

20 Claims, 3 Drawing Sheets

FLAT-TOP VALVE MEMBER FOR AN ATOMIZING PUMP DISPENSER

BACKGROUND OF THE INVENTION

This invention relates to atomizing pump dispensers in general, and more particularly to an improved flat-top valve member particularly useful in a prepressurized type atomizing pump dispenser.

With the advent of restrictions against the use of fluorocarbons in atomizing dispensers and the concern for the effects of fluorocarbons on the ozone layer, the development of pumps which can atomize with the type of fine spray previously obtainable only with a pressurized container has become increasingly important.

The most common proposal for providing good atomizing in a pump comprises carrying out some type of a pre-pressurization. A number of different prepressurized pumps have been developed which include an outlet valve arrangement which does not operate until a certain amount of pressure builds up in a pump chamber so that a fine atomization without dribble can be accomplished. Typical of such pumps are the pumps described in U.S. Pat. No. 4,025,046; U.S. Pat. No. 3,399,836; U.S. Pat. No. 4,089,442 and French patent No. 2,249,716.

Each of the pumps disclosed in the aforementioned patents include a pump chamber in which there is disposed, for reciprocal motion, a piston having a stem integral therewith. The piston contains a central axial bore at the inner end of which there is disposed a valve member which maintains an inlet port to that bore closed until pressure builds up in the pump chamber due to an inward depression of the pump stem. Each of the pumps also includes biasing means, typically a spring, which holds the valve member against the port until a sufficient differential pressure builds up to move it away from the inlet port. All of these pumps also include a valve means at the inlet to the pump chamber. The purpose of the valve means is to permit refilling of the pump during an outward stroke, but to prevent backflow of the material from the pump chamber during a dispensing stroke. The most common manner of achieving the inlet valve is by means of a check valve. Thus, Pechstein, in U.S. Pat. No. 3,399,836, utilizes a ball check valve for this purpose. In French patent No. 2,249,716, the check valve is in the form of a rubber gasket disposed about an extension of the valve member and retained by a plastic cover. When the pump is operated, the pressure developed therein slides the gasket on the stem inward sealing against an opening at the inner end of the pump chamber. After dispensing, the pressure differential, due to the partial vacuum which is drawn inside the pump chamber, results in the gasket being moved upward to open a path for refilling.

In U.S. Pat. No. 4,089,442, a different type of check valve is utilized. The valve member which seals against the inlet port in the dispensing stem has a hollow portion which extends through a throat at the inner end of the pump chamber. Within this hollow section, a spring is disposed and the hollow section is placed in communication with the container. The hollow section is of a larger diameter than the rest of the valve member, being narrowed down at a point below the inlet port into the dispensing stem. This permits openings to be formed from the hollow side of the valve member. When pressure is developed in the chamber, it is pushed inward closing off the openings. When a differential pressure exists, it is pushed upward to permit fluid to flow through the hollow portion of the valve member, the openings and into the chamber.

Another device using a conventional ball check is that of U.S. Pat. No. 4,051,983. In the embodiment disclosed therein, what is therein referred to as the valve member and which both acts to seal at the inner end of the pump chamber and to seal off the inlet port to the dispensing stem, is made of three pieces. There is an upper portion which extends into an opening in the piston and dispensing stem assembly to form, with the inlet port to the dispensing stem, a valve. This part has a hollow portion at its inner end. The hollow portion has a plurality of openings formed therein, and retains a ball. To hold the ball in place a third part is inserted into the hollow portion forming an extension of the valve member. This part carries out the necessary sealing in the inner end of the pump chamber.

The aforementioned U.S. Pat. No. 4,025,046, particularly in the embodiment shown in FIG. 4, dispense without the need for a separate inlet valve using instead cooperation between the valve member and a throat formed at the inner end of the pump chamber. The valve member is constructed so that when the pump is in its at-rest position with the valve member, piston and dispensing stem all fully outward, the valve member, either by means of appropriate channels, tapering or sizing, opens up a path of communication between the container and the pump chamber. This was first disclosed and claimed in U.S. Pat. No. 4,113,145, granted to Philip Meshberg on Sept. 12, 1978, being an improvement on his earlier U.S. Pat. No. 3,211,346 granted Oct. 12, 1965.

Although this principle works quite well in most instances, particularly where the pump chambers are relatively small, or where a measured does is required, there are situations where it does not operate as well as might be desired. Most importantly, if the operator does not allow the stem to return to its fully outward position, i.e., where he executes short strokes, the inlet valve to the pump chamber will not open to allow it to refill. It must be noted that in such an arrangement the inlet to the pump chamber is not opened until the piston has almost reached its at-rest position. On the other hand, when using a conventional check valve, the pump chamber begins refilling almost immediately upon the beginning of the outward stroke. This allows short strokes. A problem can also occur if the operator, instead of releasing the dispensing stem all at once, lets it slowly come out. This permits leakage of air around the piston and improper refilling.

Accordingly, efforts have been made to provide an improved valve member for a pump of the general type described above which comprises a minimum number of pieces and which is easy to assemble.

Many of these objects are achieved, by the construction of the U.S. Pat. No. 4,230,242. In this patent, the pump includes a valve member having an outer solid portion which projects into an opening below the piston and acts to close off an inlet port to the dispensing stem, and an inner larger section which is hollow on the inside and adapted to receive a biasing spring. This valve member is molded in one piece with a recess formed therein directly outward of the hollow area in the inner portion. The recess is narrowed to a throat at the point where it communicates with the hollowed area, with the throat of a diameter smaller than the rest of the recess and smaller than the diameter of a steel ball which is to be used as the ball check. The recess is maintained in communication with the pump chamber by means of openings which extend through the valve member. With this simple assembly, the valve member operates as a triple seal valve member, the outer part of the valve member acts to seal against the inlet port to the dispensing stem, the inner part of the valve member seals against the throat at the inner end of the pump chamber and the ball check valve acts as a further seal during dispensing.

Furthermore, the use of the valve member in combination with a flexible annular seal results in improved sealing at the inlet of the pump chamber, while still permitting fast refilling by means of the ball check valve. The inner portion of the valve member which is hollowed out to receive a spring can be made so as to form an additional inlet valve or may be manufactured so that it is always in sealing contact with the flexible annular seal.

Despite the advantages offered by the pump construction of U.S. Pat. No. 4,230,242, in some instances, problems result because the area of the point at which the outlet area of the point at which the outlet through the stem was sealed has typically been kept to a minimum. It has generally been thought that this is desirable since it is easier to effectively seal a smaller rather than larger area. What this means is that, the area available for the pressure mechanism to act against the biasing force and open the outlet is not substantially different than the area available immediately after opening. Thus, continued force by the user at about the same level is necessary to keep the pump operating against the spring force over its full stroke. If the user firmly and decisively pushes down on the actuator, a single puff will result. However, if the pressure is applied slowly and not smoothly a series of puffs result and the operator can vary the dose considerably.

With respect to prepressurized pumps which do not utilize ball check valves, one possible solution to this problem is proposed in U.S. Pat. No. 4,735,347. In the pump disclosed in this application, the sealing area at the outlet is increased substantially, e.g. over ten times. This increase in the sealing area has a number of effects. First of all, it reduces the effective piston area. The reduction of effective piston area results in an increased pressure for a given finger force. It also decreases the area of the valve member on which the pressure acts before opening. This, in turn, permits the use of a lighter spring for a given pressure. When the valve does open, the area available for the pressure to act upon is increased substantially. Although, after opening, the pressure will drop somewhat due to the flow, there is a resistance to flow, particularly because of the break-up actuator. The pressure in the chamber, thus, acts on a much greater area, developing a greater force, which acts against the valve member and drives the valve member down against biasing spring which, as noted above, can already be of a smaller force. The result, as far as the finger is concerned, is similar to the result where one is pushing against something and overcomes static friction. It is essentially impossible for the average person to control the resulting finger movement which occurs after having built up force in the finger with the back pressure released to the extent it is. The result is that a full stroke is accomplished immediately with a single puff of finely atomized spray, atomization taking place at a higher pressure than in other pumps.

While increasing the area of the point at which the outlet through the stem is sealed offers the advantage of one-shot dispensing, it also presents a variety of problems when employed in a valve member utilizing a ball check valve such as in U.S. Pat. No. 4,230,242. Specifically, use of a large diameter stem top requires a tight seal between the ball and the recess in which the ball is seated. However, the provision of such a tight seal increases the vacuum created after the product is dispensed from the pump chamber. This vacuum could result in pump lock up wherein the pump stem is unable to return to its outermost position because the spring cannot overcome the locking force of the vacuum. Further, the high pressure build up necessary before the stem moves can create an unnatural feeling for the user since a large force is required to initiate movement.

SUMMARY OF THE INVENTION

It is the object of the present invention to provide a flat top valve member for use in a pump assembly of the type shown in U.S. Pat. No. 4,230,242 so as to provide one-shot dispensing. It is a further object of the invention to provide a valve member which overcomes the aforementioned problems associated with the use of a flat top valve member in such a pump assembly.

These objects are achieved by the construction of the present invention. The valve member of the present invention has an outer part having a flattened outer end so that the diameter of the sealing area in the outlet is increased substantially (e.g. not less than one-third the diameter of the inner part of the valve member.) This increase in the diameter of the sealing area, while not as dramatic as the increase in the aforementioned application, offers some of the known benefits. Further, although some prior prepressure pumps have similar ratios (see for example U.S. Pat. Nos. 4,389,003 and 4,113,145), they do not provide the other below noted features in combination therewith to provide the improved operation attainable with the pump of the present invention. The recess within the valve member is modified to provide conical ball sealing portions tapered at an angle of 12° and 5° respectively to provide a tight seal between the ball and the valve member. The innermost end of the inner hollow part of the valve member has a reduced diameter portion such that initial movement of the valve member is easier. This in effect, tricks the user's finger by easing the initiation of movement of the actuator so as to give the feel of free movement. The inner hollow part of the valve member is provided with a molded-in slotted protrusion for breaking the seal between the valve member and the flexible annular seal, thus alleviating the creation of the vacuum caused by the tight seal between the ball and the ball seat.

Figure 1:
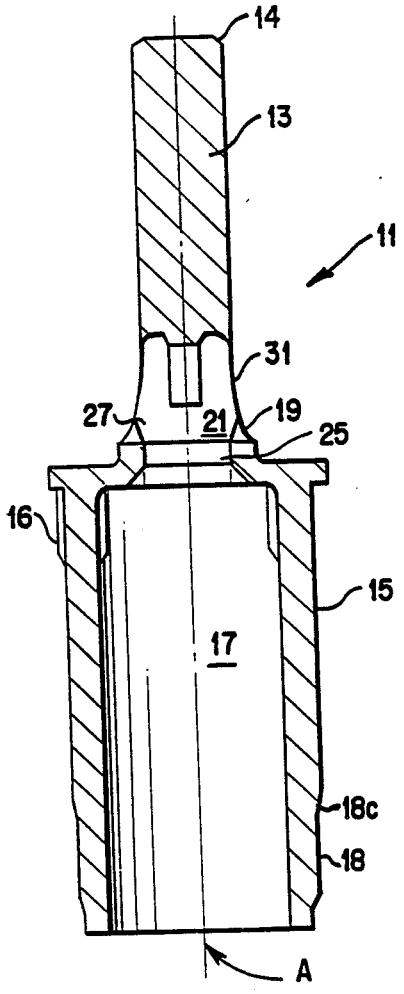
FIG. 1 is a cross-sectional view of the valve member of the present invention.

there is a stepped position 107 between walls 101 and 95. Inside the pump chamber at this point is disposed a flexible annular seal 107. The seal is made of a material of a different hardness than the material from which the valve member 11 is made. Typically, it will be softer, although the reverse is possible. The seal 107 includes a portion 109 which projects axially outward and radially inward to contact the outside of the lower portion 15 of the valve member 11 to make sealing contact therewith. A projection 111 is formed on the inside wall of the pump chamber 73 to retain the flexible annular seal 107 in place. The annular chamber 93 also has an inner annular wall 113 joining the walls 97 and 95. Disposed between the wall 113 and outer end 121 of the hollow recess 17 of the valve member, at which point the lower portion 15 and intermediate portion 19 are joined, is a spring 123 which biases the valve member 11 outward. This outward biasing brings the sealing surface 14 into contact with the port 83 and at the same time biases the piston and stem assembly 75 axially outward into the position shown.

In the position shown, leakage of material out of the pump, even if the container to which it is attached is inverted, is prevented by means of the seal formed by the upper cylindrical part 87 of the piston with the gasket 47 and by the sealing edges 71 and 69. In operation, an actuator is typically placed over the end of the stem 77 and the stem depressed. Upon initial depression, presuming that the pump chamber 73 is filled, the piston causes a build up of pressure therein. This pressure acts against the ball 23 causing it to seal against the conical portion 27. Sealing at the inner end of the chamber 73 is maintained by means of flexible annular seal 107. The pressure builds up within the pump chamber 73. Because the size of the opening through which the inner portion 15 of valve member passes is greater than the size of the port 83, there is an overall differential in forces with a net inward force. This force must be sufficient to overcome the force of spring 123. When such occurs, the valve member 11 moves inward moving the conical portion 91 away from the port 83 and allowing dispensing to occur, but only after a predetermined pressure has been build up within the pump chamber. Dispensing continues until the piston moves fully inward.

As indicated above, and as shown in FIG. 1, the valve member 11 of the present invention has a flattened top portion having a diameter which is not less than one-third the outer diameter of the inner portion 15 such that the sealing surface 14 is wider than conventional valve members. This flattened top offers significant advantages in certain applications.

For instance, the increased sealing area results in a reduced area for the finger force (five pounds for example), to work since the area in which this force acts in attempt to move the valve member 11 inwardly against the force of the biasing spring 123 is the area of the inner portion 15 minus the area of the sealing surface 14. Thus, by increasing the area sealed by the sealing surface 14, the area at which the pressure created by the finger force has to act is reduced such that a smaller force is applied in the direction tending to push the valve member against t he bias of the spring 123. Thus, a lighter spring can be utilized even though the pressure within the chamber reaches an even higher level to carry out better atomization. This spring can now be designed merely to return the piston and valve member to their original position and create a seal. Extra force to insure atomization is not needed. Instead this force has been built up hydraulically.

Moreover, since the sealing surface 14 makes substantially planar contact rather than linear contact with the inner surface of the piston stem 77, better sealing at this point is insured.

Another significant benefit resulting from the use of a flat top valve member is best understood by considering what occurs in the case of the FIG. 1 embodiment, when the spring force is overcome and the valve member 11 is moved inwardly to open up the port 83. Particularly, on a dispensing stroke after the first stroke, the chamber 73, will be filled with fluid. Thus, upon initial opening before an considerable flow occurs, the pressure which was built up in the chamber will remain at that level, at least momentarily. This pressure will act on the area it had been acting on upon previously, plus the additional area of the port which was sealed by the sealing surface 14. Thus, because of the increased diameter of the area sealed by the sealing surface of the flat top valve member, the additional area is increased. The result is an increase in the force acting against the spring. Up until this point, there was a resistance to movement and the operator's finger was pressing against the stem that was building up hydraulic pressure, or in a sense, "sticking". When the valve opens, the hydraulic pressure acting on the greater surface area increases the force on the stem. As a result, the valve member 11 moves inwardly rapidly and it becomes difficult to stop the movement of the finger inwardly for the full stroke of the pump, the dispensing of a single puff of atomized liquid with the atomizing taking place at a higher pressure than in the prior art devices.

Figure 4A:
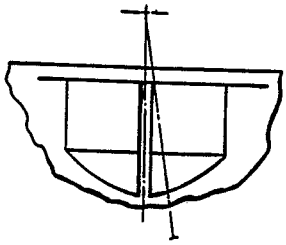
FIGS. 4(A)–(C) diagrammatically illustrate the molded-in protrusion of the valve member shown in FIG. 1.
Figure 4C:
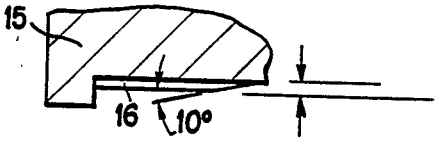
Figure 4B:
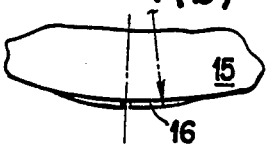

At this point the operator normally releases the actuator and the force of the spring 123 pushes the valve member 11 and with it the stem and piston assembly outward. However, it has been found that in some instances, the seal between the seal 107 and the inner part 15 of the valve member 11 may be so tight as to prevent the spring from returning the valve member 11 and piston assembly 75 to the outward position. Thus, in accordance with another aspect of the present invention, a molded-in protrusion or burp 16 is provided on the radially outermost surface of the inner part 15 proximate the intermediate portion 19. This feature is best illustrated in FIGS. 4(*a*) to 4(*c*). Specifically, FIGS. 4(*b*) and 4(*c*) illustrate in a dimensionally accurate sense the structure of the molded-in burp. As best shown in FIG. 4(*b*), a molded-in burp is relatively small in the radial direction and includes a slot, which serves as an air passageway, at the point of its greatest radial extent. As shown in FIG. 4(*c*) the molded-in burp is relatively long in the circumferential direction and is tapered into the surface of the inner part at an angle of about 10°. FIG. 4(*a*) schematically represents the structure of the molded-in burp showing particularly well, the arc like shape of the molded-in burp as well as the slot formed at the greatest radial extent of the molded-in burp.

When the valve member is in its innermost condition, i.e., the position where the valve member may tend to form a tight seal with the seal 107, the molded-in burp serves to break the sealing contact between the seal 107 and the inner part 15. Further, air may pass through the slot formed in the molded-in burp 16 thereby momentarily preventing the maintenance of a vacuum in the chamber 73. Thus, the spring 123 is able to begin returning the valve member 11 to the outermost position.

DETAILED DESCRIPTION OF THE INVENTION

Figure 2:
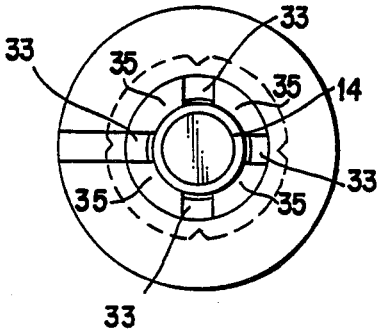
FIG. 2 is a top view of the valve member shown in FIG. 1.

FIG. 1 is a cross sectional view through the valve member of the present invention and FIG. 2 a top view of the valve member of FIG. 1. The valve member 11 has an outer part 13 having a sealing surface 14 which is used for sealing an outlet port in a manner to be more fully described below, and in an inner hollow part 15, having a hollow recess 17. The diameter of the area sealed by the sealing surface 14 is at least one-third the outer diameter of the inner hollow part 15 giving the valve a flat top appearance.

Interposed between the inner and outer parts of the valve is an intermediate hollow portion 19 forming therein a recess 21 in which there is disposed a ball 23 (FIG. 3), preferably of stainless steel. Recess 21 is in communication with the hollow portion of the inner part 15 of the valve member 11 through a narrowed throat section 25. Extending outward from the narrowed throat area 25, is a tapered conical portion 27 terminating in oppositely tapered ribbed portion 31. The tapered ribbed portion 31 includes ribs connecting the outer part 13 of the valve member 11 to the intermediate portion 19. The conical portion 27 is tapered at a small angle with respect to the axis A of the valve member to insure a good seal between the ball 23 and the conical portion 27. Generally, a better seal is achieved as the angle of tapering becomes smaller. However, the present inventors have discovered that when the angle of tapering is less than 10° with respect to the axis of the valve member, the seal becomes too good and the ball 23 tends to stick in the seat formed by the tapered conical portion 27. Thus, best results are achieved when angle of tapering is between 10° and 20°, preferably 12°. The conical portion 31 is also tapered at a small angle with respect to the axis A of the valve member (preferably 5°).

A molded-in protrusion or burp 16 is provided on the radially outer surface of the inner part 15 proximate the intermediate portion 19. The structure and function of this molded-in burp are discussed more fully in connection with FIGS. 4(A)–4(C) below.

The outer surface of the inner part 15 also includes a reduced diameter portion 18 at its innermost end and a tapered connecting portion 18*c* connecting the reduced diameter portion 18 to the remainder of the outer surface of the inner part 15. Although the amount of reduction of the diameter is relatively small, preferably less than 5%, it offers a significant advantage. Specifically, since the diameter is smaller at the end of the valve member 11 which is initially in contact with the flexible seal 107, there is an incomplete seal between these two elements and the initial movement of the piston 75 and the valve member 11 against the bias of the spring 123 is made easier. This in effect tricks the user by offering little resistance to the initial movement, such that the initial movement generates momentum which helps generate the force necessary to create sufficient pressure to operate the pump. The reduced diameter also aids in the prevention of pump lock up by lessening the sealing effect between the end of the valve member and the seal 107.

The valve member, except for the ball 23, is molded, in a single piece of plastic, such as polypropylene. The ball is snapped into place from the inner end past the throat 25. In the position shown which is its position during sealing, it rests against the tapered conical portion 27. The inside diameter of the portion 31 of the recess is larger than the outside diameter of the ball so that, under the influence of a differential pressure, it can move outward to permit fluid to flow therearound through openings 35 between the ribs 33 into a pump chamber in a manner to be more evident when discussing FIG. 3 below.

Figure 3:
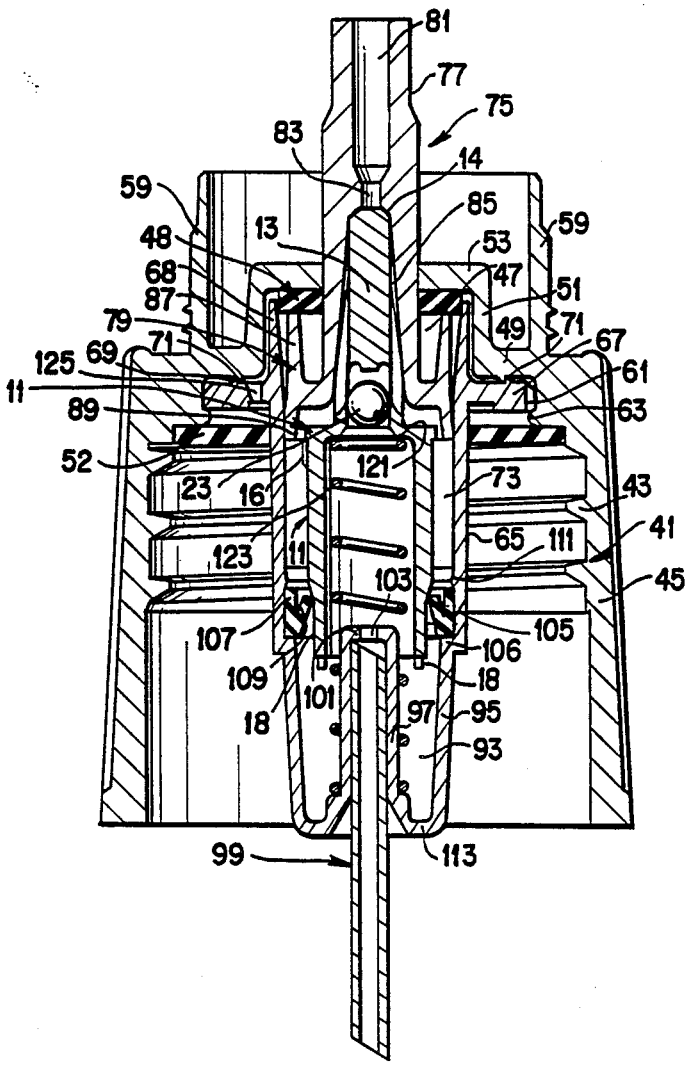
FIG. 3 is a cross-sectional view through a pump having installed therein the valve member of FIG. 1.

FIG. 3 illustrates a pump utilizing the valve member of the present invention. The particular pump illustrated in FIG. 3 is one adapted to screw onto a bottle and thus includes a cap portion 41 with internal threads 43 on the inside of a side wall 45 of cylindrical or slightly conical cross section. However, pumps which, instead of a cap, utilize a mounting cup for crimping to a bottle or can, can be equally well constructed using the valve member of the present invention. The pump of the present invention is installed within the cap 41.

Extending from the side wall 45, which is cylindrical or slightly conical, is a horizontal portion 49. This portion 49 continues as a vertical portion 51, and a further horizontal portion 53. Portions 51 and 53 form an annular recess 47. An annular edge of the horizontal portion 53 forms a central opening 57 in the cap. An additional vertical wall 59 projects outwardly from the horizontal portion 49 and can be used as a guide for an atomizer head. Formed below the wall 49 is an additional cylindrical recess 61. Projections 63 are molded directly below this recess. This permits snapping into the recess 61 a pump body 65 having at its upper or outer end a horizontal flange portion 67. The flange is snapped into place in the recess 61, past the projections 63. Both the flange 67 and the portion 49 are molded with annular projections 69 and 71, respectively, of a triangular cross section, to aid in sealing at this point. The pump body also includes a vertical flange portion 68 at its outer or upper end portion. An annular gasket 48 is disposed in the outer part of the annular opening 47. A second annular gasket 52 is disposed between the cap 41 and the pump body 65.

Within the pump chamber 73 of the pump body 65 is located a stem and piston assembly 75 having a stem portion 77 and a piston portion 79 at the inner end thereof. The stem 77 includes an outlet passage 81 which is supplied through an axial inlet port 83. Directly inward of the port 83 is a hollow recess 85 of a shape capable of accepting the outer portion 13 of the valve member 11. The axial inlet port 83 includes a conically tapered surface tapered at an angle equal to the angle at which the sealing surface 14 is tapered such that the sealing surface is adapted for flush contact with the conically tapered surface of said inlet port.

The piston 79 is of a generally cylindrical shape having, with respect to the point of attachment to the stem, an upper cylindrical projection 87 and a lower cylindrical projection 89. The projecting portion 89 has a slight outward taper to make firm contact with the walls of the pump chamber 73.

The valve member of FIG. 1 is also disposed in the pump chamber with the outer portion 13 thereof in the recess 85 with sealing surface 14 contacting and closing off port 83 when in the position shown. The pump body, in addition to the pump chamber, contains an annular chamber 93 therebelow. The annular chamber 93 has a radially outer wall 95 and a radially inner wall 97. The inner wall 97 is sized to accept a dip tube 99. A horizontal wall 101 with a port 103 is molded integrally with the wall 97. The outer wall 95 is of a smaller diameter than the wall 105 of the pump chamber 73. Thus, As the spring 123 pushes the valve member 11 and the stem and piston assembly outward, a partial vacuum is created within the chamber 73. The contents within the container will be acted upon by ambient air pressure, since, during the dispensing stroke, the container was vented by means of a gap between the circular opening 57 and the stem 77, through a hole 125 into the container. The resulting differential pressure acts on the ball 23 moving it outward so that a flow path through the dip tube 99, the hollow recess 17, past the ball 23, through the openings 35 and into the pump chamber 73 is established. Such refilling begins as soon as the outward stroke of the pump commences. Thus, even if movement is restrained by the operator, i.e., if he lets the stem move slowly or if there is slight deformation of the piston portion 89, refilling of the chamber 73 will occur.

What is claimed is:

1. An atomizing dispensing pump comprising:

(a) a pump chamber of substantially fixed volume, said pump chamber having an opening at the inner end thereof;

(b) a pump stem having a piston on the end thereof disposed for reciprocal motion in said pump chamber;

(c) said pump stem having a passageway therethrough with a dispensing outlet at the outer end of said passageway and an axial inlet port located inwardly thereof;

(d) an integrally molded plastic rigid valve member having:

(i) an outer part terminating in a flattened top portion and a sealing surface adjacent said flattened top portion, said sealing surface having a predetermined diameter and sealing against said axial inlet port, said outer part being of a first cross section;

(ii) an inner part being of a larger cross section than said outer part, and of a length corresponding to the range of movement of said piston, the outer diameter of said inner portion being no more than three times the diameter of said sealing surface;

(iii) an intermediate portion forming a generally conically tapered recess with a wide edge and a narrow end between said inner and outer parts, said recess being tapered at an acute angle with respect to the axis of said inner part;

(iv) a passage leading from the axial inner end of said inner part to said tapered recess;

(v) said intermediate portion openings in the vicinity of its outer end permitting communication between said recess and the area above said inner portion; and (vi) a ball, having a diameter which is less than the diameter of said wide edge of said tapered recess but greater than the diameter of said narrow end, snapped into said tapered recess to thereby form therewith a check valve, said valve member thereby forming an inlet valve to said pump chamber, (e) a throat at said opening at the inner end of said pump chamber, the radially outer portion of said inner part of said valve member cooperating with said throat to form means sealing the inner end of said pump chamber with a surface to surface seal at said throat, as said pump is operated by depressing said pump stem, to prevent any flow from said pump chamber through said throat when said pump is dispensing;

(f) a dip tube for supplying liquid in a container to said throat;

(g) a spring biasing said valve member outwardly so that the first end portion thereof closes off said inlet port, and thereby also biasing said pump stem outwardly; and (h) the cross-sectional area closed off at said inlet port being smaller than the cross-sectional area of said second end portion of said valve member at the point where it is sealingly guided.

2. The pump according to claim 1 wherein said valve member is molded of polypropylene.

3. The pump according to claim 1 wherein said tapered recess is tapered at an angle between 10° and 20° with respect to the axis of said inner part.

4. The pump according to claim 1 wherein each of said inner and outer portions are of a generally cylindrical shape and wherein the diameter of the wide edge of the tapered recess in said intermediate portion is greater than the diameter of said outer portion and wherein said outer portion and said intermediate portion are connected by a plurality of ribs extending radially outward from said outer portion and attached to said intermediate portion at said wide edge, the spaces between said ribs being open and forming the openings from said cylindrical recess to said area above said inner portion.

5. The pump according to claim 1 wherein said inner part has a generally cylindrical outer surface, said outer surface having a reduced diameter cylindrical portion at its innermost end and a connecting portion connecting the reduced diameter portion to the remainder of the outer surface.

6. The pump according to claim 1 wherein said inner part has a generally cylindrical outer surface and further including a radial protrusion formed on said outer surface proximate said intermediate portion.

7. The pump according to claim 6 wherein said radial protrusion is tapered and includes a point of greatest radial extent, a slot in said radial protrusion extending from said outer surface of said inner part to the point of greatest radial extent of said radial protrusion.

8. The pump assembly according to claim 6 further including an air passageway formed in said radial protrusion.

9. The pump according to claim 1 where said inlet port includes a conically tapered surface tapered at a predetermined angle and said sealing surface is conically tapered at an angle which is equal to said predetermined angle such that said sealing surface is adapted for flush contact with said conically tapered surface of said inlet port.

10. The atomizing dispensing pump of claim 1 further comprising an annular member forming said throat, said annular member being disposed at said opening at said inner end of said chamber; and detents formed on the inside of said pump body to retain said annular member in place.

11. The atomizing dispensing pump of claim 1 wherein said inner part further includes a hollow recess open at its inner end for accepting said biasing means and a narrowed second throat formed at he area of communication between said hollow recess and said tapered recess.

12. An atomizing dispensing pump comprising:

(a) a pump chamber of substantially fixed volume, said pump chamber having an opening at the inner end thereof;

(b) a pump stem having a piston on the end thereof disposed for reciprocal motion in said pump chamber;

(c) said pump stem having a passageway therethrough with a dispensing outlet at the outer end of said passageway and an axial inlet port located inwardly thereof;

(d) an integrally molded plastic rigid valve member having:

(i) an outer part terminating in a flattened top portion and a sealing surface adjacent said flattened top portion, said sealing surface having a predetermined diameter and sealing against said axial inlet port, said outer part being of a first cross section;

(ii) an inner part being of a larger cross section than said outer part, and of a length corresponding to the range of movement of said piston;

(iii) an intermediate portion forming a generally conically tapered recess with a wide edge and a narrow end between said inner and outer parts, said recess being tapered at an angle between 10° and 20° with respect to the axis of said inner part;

(iv) a passage leading from the axial inner end of said inner part to said tapered recess;

(v) said intermediate portion openings in the vicinity of its outer end permitting communication between said recess and the area above said inner portion; and (vi) a ball, having a diameter which is less than the diameter of said wide edge of said tapered recess but greater than the diameter of said narrow end, snapped into said tapered recess to thereby form therewith a check valve, said valve member thereby forming an inlet valve to said pump chamber;

(e) a throat at said opening at the inner end of said pump chamber, the radially outer portion of said inner part of said valve member cooperating with said throat to form means sealing the inner end of said pump chamber with a surface to surface seal at said throat, as said pump is operated by depressing said pump stem, to prevent any flow from said pump chamber through said throat when said pump is dispensing;

(f) a dip tube for supplying liquid in a container to said throat;

(g) a spring biasing said valve member outwardly so that the first end portion thereof closes off said inlet port, and thereby also biasing said pump stem outwardly; and (h) the cross-sectional area closed off at said inlet port being smaller than the cross-sectional area of said second end portion of said valve member at the point where it is sealingly guided.

13. The pump according to claim 12 wherein said valve member is molded of polypropylene.

14. The pump according to claim 12 wherein said inner part has a generally cylindrical outer surface, said outer surface having a reduced diameter cylindrical portion at its innermost end and a connecting portion connecting the reduced diameter portion to the remainder of the outer surface.

15. The pump according to claim 12 wherein said inner part has a generally cylindrical outer surface and further including a radial protrusion formed on said outer surface proximate said intermediate portion.

16. The pump according to claim 15 wherein said radial protrusion is tapered and includes a point of greatest radial extent, a slot in said radial protrusion extending from said outer surface of said inner part to the point of greatest radial extent of said radial protrusion.

17. An atomizing dispensing pump comprising:

(a) means defining a pump chamber of substantially fixed volume, said pump chamber having an opening at the inner end thereof;

(b) a pump stem having a piston on the end thereof disposed for reciprocal motion in said pump chamber;

(c) said pump stem having a passageway therethrough with a dispensing outlet at the outer end of said passageway and an axial inlet port located inwardly thereof;

(d) an integrally molded plastic rigid valve member having:

(i) an outer part terminating in a flattened top portion and a sealing surface adjacent said flattened top portion, said sealing surface sealing against said axial inlet port, said outer part being of a first cross section;

(ii) an inner part being of a larger cross section than said outer part, and of a length corresponding to the range of movement of said piston, the inner part having a generally cylindrical outer surface having a reduced diameter cylindrical portion at its innermost end and a connecting portion connecting the reduced diameter portion to the remainder of the outer surface;

(iii) an intermediate portion forming a generally conically tapered recess with a wide edge and a narrow end between said inner and outer parts;

(iv) a passage leading from the axial inner end of said inner part to said tapered recess;

(v) said intermediate portion openings in the vicinity of its outer end permitting communication between said recess and the area above said inner portion; and (vi) a ball, having a diameter which is less than the diameter or said wide edge of said tapered recess but greater than the diameter of said narrow end, snapped into said tapered recess to thereby form therewith a check valve, said valve member thereby forming an inlet valve to said pump chamber.

(e) a throat at said opening at the inner end of said pump chamber, the radially outer portion of said inner part of said valve member cooperating with said throat to form means sealing the inner end of said pump chamber with a surface to surface seal at said throat, as said pump is operated by depressing said pump stem, to prevent any flow from said pump chamber through said throat when said pump is dispensing;

(f) means for supplying liquid in a container to said throat;

(g) means biasing said valve member outwardly so that the first end portion thereof closes off said inlet port, and thereby also biasing said pump stem outwardly; and (h) the cross-sectional area closed off at said inlet port being smaller than the cross-sectional area of said second end portion of said valve member at the point where it is sealingly guided.

18. The pump according to claim 17 wherein said valve member is molded of polypropylene.

19. The pump according to claim 17 wherein said inner part has a generally cylindrical outer surface and further including a radial protrusion formed on said outer surface proximate said intermediate portion.

20. The pump according to claim 19 wherein said radial protrusion is tapered and includes a point of greatest radial extent, a slot in said radial protrusion extending from said outer surface of said inner part to the point of greatest radial extent of said radial protrusion.

* * * * *